US010309209B2

(12) United States Patent
Caballero et al.

(10) Patent No.: US 10,309,209 B2
(45) Date of Patent: Jun. 4, 2019

(54) ELECTRIC SUBMERSIBLE PUMP SUCTION DEBRIS REMOVAL ASSEMBLY

(71) Applicant: BAKER HUGHES, A GE COMPANY, LLC, Houston, TX (US)

(72) Inventors: John W. Caballero, Corpus Christi, TX (US); Courtney J. Hartman, Midland, TX (US); Paul L. Connell, Comanche, TX (US); Eric J. Gauthier, Midland, TX (US); Steve Rosenblatt, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 151 days.

(21) Appl. No.: 15/462,264

(22) Filed: Mar. 17, 2017

(65) Prior Publication Data

US 2018/0266230 A1 Sep. 20, 2018

(51) Int. Cl.

| | |
|---|---|
| ***E21B 43/12*** | (2006.01) |
| ***E21B 37/00*** | (2006.01) |
| ***E21B 43/08*** | (2006.01) |
| ***E21B 43/38*** | (2006.01) |

(52) U.S. Cl.
CPC ..... *E21B 43/38* (2013.01); *E21B 37/00* (2013.01); *E21B 43/08* (2013.01); *E21B 43/128* (2013.01)

(58) Field of Classification Search
CPC ..... E21B 43/38; E21B 43/128; E21B 33/12; E21B 37/00; E21B 43/08; E21B 27/00; E21B 27/005; E21B 27/04; E21B 40/00; E21B 37/08
USPC ..... 166/105.1, 105.3
See application file for complete search history.

(56) References Cited

U.S. PATENT DOCUMENTS

| | | | | |
|---|---|---|---|---|
| 2,993,539 | A * | 7/1961 | Baker | E21B 37/00 166/117 |
| 5,314,018 | A * | 5/1994 | Cobb | E21B 43/38 166/105.1 |
| 6,216,788 | B1 | 4/2001 | Wilson | |
| 6,276,452 | B1 * | 8/2001 | Davis | E21B 21/002 166/107 |
| 6,951,251 | B2 * | 10/2005 | Penisson | E21B 27/00 166/312 |
| 7,472,745 | B2 * | 1/2009 | Lynde | E21B 27/005 166/165 |
| 7,610,957 | B2 * | 11/2009 | Davis | E21B 29/002 166/162 |
| 7,703,508 | B2 | 4/2010 | Orban | |
| 7,753,113 | B1 * | 7/2010 | Penisson | E21B 27/00 166/162 |
| 7,861,772 | B2 * | 1/2011 | Blair | E21B 29/002 166/162 |

(Continued)

FOREIGN PATENT DOCUMENTS

WO 2012036854 A2 3/2012

*Primary Examiner* — Michael R Wills, III
(74) *Attorney, Agent, or Firm* — Shawn Hunter

(57) ABSTRACT

An electric submersible pump (ESP) is coupled with a spaced apart debris removal assembly that is independently supported from a retrievable packer. The debris removal assembly is modular and retains the captured debris for subsequent removal from the well with the retrievable packer. The ESP suction draws in well fluids through the debris retention device. The ESP can be pulled to allow removal of the retrievable packer with the debris removal assembly.

16 Claims, 2 Drawing Sheets

(56) References Cited

U.S. PATENT DOCUMENTS

| | | | | |
|---|---|---|---|---|
| 8,136,587 | B2 * | 3/2012 | Lynde | E21B 37/02 166/173 |
| 8,584,744 | B2 * | 11/2013 | Soni | E21B 27/04 166/99 |
| 8,961,153 | B2 | 2/2015 | Wilson et al. | |
| 9,097,094 | B1 | 8/2015 | Frost | |
| 2007/0272404 | A1 | 11/2007 | Lynde et al. | |
| 2008/0110614 | A1 | 5/2008 | Orban | |
| 2010/0258296 | A1 | 10/2010 | Lynde et al. | |
| 2010/0270018 | A1 * | 10/2010 | Howlett | E21B 27/00 166/301 |
| 2012/0298369 | A1 * | 11/2012 | Knobloch, Jr. | E21B 21/12 166/311 |
| 2015/0064035 | A1 | 3/2015 | Tujula et al. | |
| 2016/0333668 | A1 | 11/2016 | Xu et al. | |

* cited by examiner

ELECTRIC SUBMERSIBLE PUMP SUCTION DEBRIS REMOVAL ASSEMBLY

FIELD OF THE INVENTION

The field of the invention is artificial lift systems and more particularly an independently supported and selectively removable modular suction debris removal device for an electric submersible pump (ESP).

BACKGROUND OF THE INVENTION

Wells that lack the formation pressure to produce to a surface location have used an ESP to boost pressure sufficiently for that purpose. It is desirable to exclude debris from the suction of the ESP and various schemes attached to the suction of the ESP have been proposed in the past. Some examples of such designs are U.S. Pat. No. 7,703,508 where an intake screen has a bypass feature if it clogs with debris and U.S. Pat. No. 7,503,389 FIG. 8 showing concentric screens supported by the suction connection on the ESP. U.S. Pat. No. 6,216,788 shows using a sand separator that includes a hydrocyclone and a bypass line with an intention of using pump pressure to get the captured sand or debris to the surface. Modular porous suction filters supported by the ESP are shown in US 2015/0064034. Suction filtering is mentioned in passing for an ESP in U.S. Pat. No. 9,097,094. A seabed mounted ESP and inlet screen is described in U.S. Pat. No. 8,961,153.

A known debris removal and retention device made by Baker Hughes Incorporated and known in the industry as a VACS tool is shown in FIG. 1 of U.S. Pat. No. 7,472,745. This tool typically uses an eductor powered by pumped flow from a surface location to draw debris laden fluid into an intake pipe whereupon the debris is deflected into a surrounding annular debris retention space and the fluid stream continues up the tool through a screen and is drawn by the eductor to outside the tool housing whereupon some flow recycles back down the hole and the rest flows uphole.

The currently available ESPs have limits to the weight they can support not only for the weight of the filtration equipment but also the added weight of the captured debris. Some designs have resorted to simply dumping captured debris into the rat hole but this is merely a stopgap solution still limited by the limited weight that can be supported directly from the ESP. The present invention supports a debris removal assembly from a retrievable packer or anchor or other support in the borehole that can be sealed to the borehole wall to allow heavier structures that can capture debris so that the captured debris can be removed from the borehole when the packer is retrieved. A modular design for the debris removal assembly allows selection of the needed volume for debris retention for the anticipated debris load. The ESP provides the motive force to draw fluid into the debris removal assembly which has aspects of the VACS tool but does not use the jet bushing of the VACS tool since the application is on a pump suction as opposed to the eductor based VACS design of the past. These and other aspects of the present invention will be more readily apparent to those skilled in the art from a review of the description of the preferred embodiment and the associated drawings while recognizing that the full scope of the invention is to be determined by the appended claims.

SUMMARY OF THE INVENTION

An electric submersible pump (ESP) is coupled with a spaced apart debris removal assembly that is independently supported from a retrievable packer. The debris removal assembly is modular to accommodate required debris capacity by adapting the overall length, as well as changing the dimensional diameters for proper flow dynamics, and retains to accommodate required debris capacity by adapting the overall length, as well as changing the dimensional diameters for proper flow dynamics, and retains to accommodate required debris capacity by adapting the overall length, as well as changing the dimensional diameters for proper flow dynamics, and retains and retains the captured debris for subsequent removal from the well with the retrievable packer. The modular design allows for the addition of large debris collections and separation from fine debris collection. The ESP suction draws in well fluids through the debris retention device. The ESP can be pulled to allow removal of the retrievable packer with the debris removal assembly.

DETAILED DESCRIPTION OF THE PREFERRED EMBODIMENT

Figure 1:
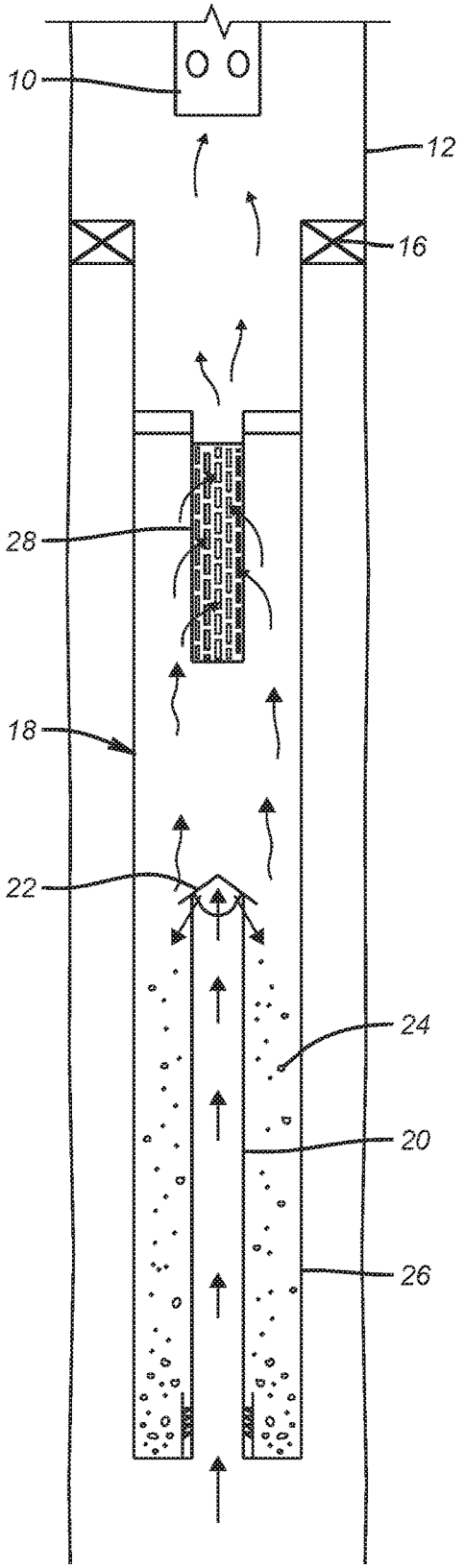
FIG. 1 is a schematic view of the assembly of an ESP with a single module of a debris removal device.
Figure 2:
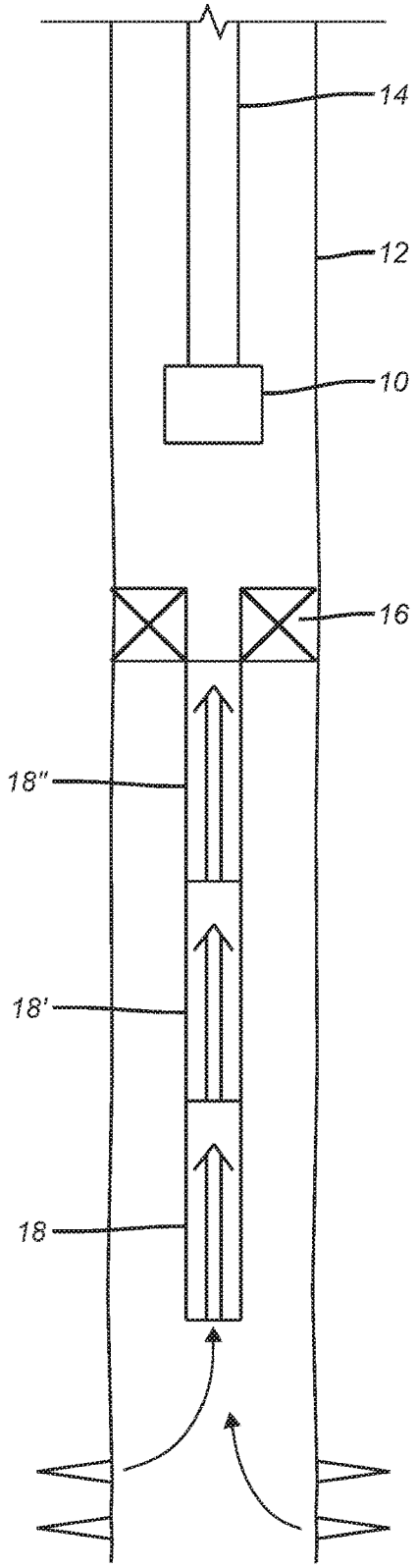
FIG. 2 shows the view of FIG. 1 with stacked modules for debris removal.

Referring to FIG. 1 an ESP 10 is supported in a borehole 12 on a tubing string 14 shown in FIG. 2. A retrievable packer 16 supports at least one debris removal module 18. Module 18 has an inlet tube 20 topped by an open deflecting cap 22 such that debris 24 settles in an annular shaped retention volume 26 that surrounds inlet tube 20. Flow continues upwardly toward ESP 10 but has to pass through a screen 28 where debris that is finer than 24 will also be stopped as the filtered fluid goes through to either another stage as shown schematically in FIG. 2 or through the packer 16 and up to the ESP 10.

Figure 3:
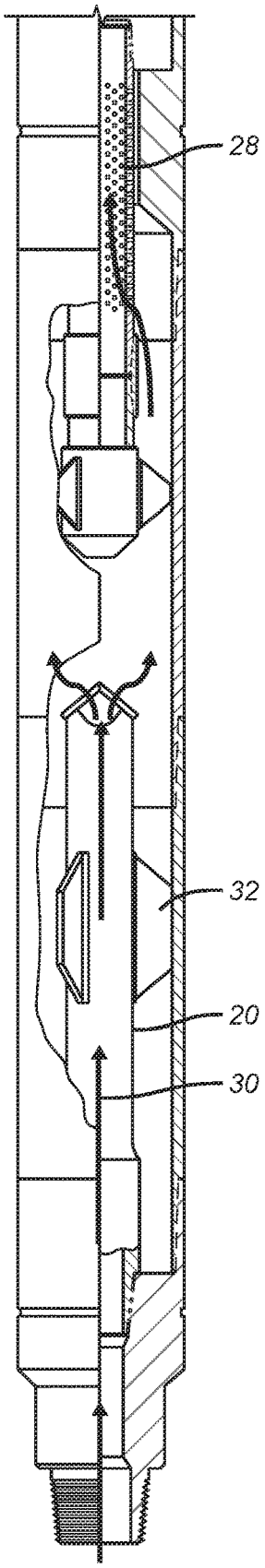
FIG. 3 shows the details of a debris removal module and the flow therethrough.

In FIG. 3 arrow 30 shows the incoming debris laden flow into the inlet tube 20 which can be centralized with radially extending members 32 with debris entering retention volume 26 able to pass between the extending members 32. As shown in FIG. 2 the modules 18, 18' and 18" can be stacked in series in any desired number. The screen 28 in each module can have the same opening size or the opening size can get smaller progressively as the flow gets closer to the ESP 10 as debris drops out in each successive stage. The number of modules can be varied depending on the debris capacity that is needed. However many modules are envisioned they are run in and supported when the packer 16 is set so that their empty weight plus the weight of captured debris is not on the ESP 10 that has limited capability to support weight. Simply turning on the ESP 10 draws debris laden flow into the inlet tube(s) 20. Each module 18 can be directly threaded to an adjacent module directly or through an intervening coupling or by using a quick connect.

Those skilled in the art will appreciate that without loading weight on the ESP 10 that it may not be able to support debris collection volume can be tailored to the application by selecting the number and length of modules and connecting them preferably directly or indirectly with a threaded connection. The assembled modules are supported by a retrievable packer that allows removal of all the modules with the packer and the captured debris. The life of the ESP or any other piece of downhole equipment can be lengthened by effective debris removal before well fluids enter a tool with moving components and close clearances that can be damaged by uncaptured debris. The use of a modified design from a traditional VACS tool allows economies of production as the jet bushing from a known VACS tool is removed in favor of modules that can be connected is series each of which features an inlet tube for debris laden flow surrounded by a collection chamber. The inlet tube has a top deflector to direct debris into the chamber while the suction flow continues toward the ESP and passes through a screen before exiting each module. The particles caught on such screens can also drop into the annular shaped retention volume with debris deflected into such volume from the inlet tube. Debris of progressively smaller diameter can be removed in sequence in a stack of such modules. The modules can be connected with threaded connections or quick snap together connections for rapid assembly or disassembly after use. While use with an ESP is a preferred application, use of an independently supported debris removal assembly can be deployed with a variety of other tools having components that would be adversely affected by passing borehole debris if such debris were not removed. Preferably, the ESP can be removed separately from the retrievable packer. Optionally the support string for the ESP can be configured to latch with a linkage onto the packer to release and retain it so that the ESP and the packer with the debris removal modules can be removed in a single trip without the ESP needing to support the weight of the debris laden modules. The debris collection chamber in each module can also have a screened drain hole or holes to avoid having to lift the weight of well fluid during the removal process.

The above description is illustrative of the preferred embodiment and many modifications may be made by those skilled in the art without departing from the invention whose scope is to be determined from the literal and equivalent scope of the claims below:

We claim:

1. A borehole method, comprising:

protecting a tool positioned in a borehole with a selectively releasable and independently supported debris removal assembly, said tool being an electric submersible pump; and removing at least some debris from fluid reaching the tool as said tool is operated.

2. The method of claim 1, comprising:

drawing fluid through said debris removal assembly with said tool.

3. The method of claim 1, comprising:

supporting said debris removal assembly at a spaced location from said tool without direct or indirect contact between said tool and said debris removal assembly.

4. The method of claim 1, comprising:

supporting said debris removal assembly on a retrievable support spaced apart from said tool.

5. The method of claim 4, comprising:

making said retrievable support a packer.

6. The method of claim 1, comprising:

providing a plurality of modules connected in series as said debris removal assembly.

7. The method of claim 6, comprising:

configuring each module with an inlet tube surround by a debris retention chamber;

deflecting flow exiting said inlet tube in each module toward said debris retention chamber so that debris can settle into said debris retention chamber.

8. The method of claim 7, comprising:

filtering said flow in each module after said deflecting.

9. The method of claim 8, comprising:

using filters with the same opening size in each said module.

10. The method of claim 8, comprising:

using filters with progressively decreasing opening size in each said module in a direction approaching said tool.

11. The method of claim 8, comprising:

connecting the modules together directly or indirectly with a threaded connection or a quick connect.

12. The method of claim 8, comprising:

providing an ESP as said tool;

supporting said modules from a retrievable packer.

13. The method of claim 12, comprising:

removing debris captured in said modules with said modules after release of said retrievable packer.

14. The method of claim 12, comprising:

removing said modules and retrievable packer in the same trip as removing said ESP.

15. The method of claim 14, comprising:

supporting said ESP on a tubular string;

manipulating said string to release and retrieve said retrievable packer and attached modules without using said ESP to support said retrievable packer.

16. The method of claim 12, comprising:

drawing fluid through said modules with said tool.

* * * * *